United States Patent [19]

Haynes

[11] 4,151,514

[45] Apr. 24, 1979

[54] MANUALLY PROGRAMMABLE AUDIBLE ALARM SYSTEM

[75] Inventor: Ben R. Haynes, Houston, Tex.

[73] Assignee: Mobil Oil Corporation, New York, N.Y.

[21] Appl. No.: 820,052

[22] Filed: Jul. 29, 1977

[51] Int. Cl.[2] ..... G08B 23/00

[52] U.S. Cl. ..... 340/286 R; 340/384 E; 340/517; 340/539; 340/309.1

[58] Field of Search ..... 340/224, 286 R, 168 R, 340/345, 384 E, 309.1, 517, 539

[56] References Cited

U.S. PATENT DOCUMENTS

| | | | |
|---|---|---|---|
| 2,899,674 | 8/1959 | Sierer | 340/224 X |
| 2,979,706 | 4/1961 | Simon | 340/224 X |
| 3,909,826 | 9/1975 | Schildmeier | 340/224 X |

*Primary Examiner*—Harold I. Pitts

*Attorney, Agent, or Firm*—C. A. Huggett; George W. Hager, Jr.

[57] ABSTRACT

An audible alarm system provides for a manually operated switch by which the location of an emergency can be manually coded into a storage medium. An audible alarm is sounded in response to the operation of such switch, indicating an emergency. Following this alarm, a plurality of successive audible tones are sounded to indicate the location of an emergency, one such tone being sounded for each operation of the manually operable switch.

5 Claims, 5 Drawing Figures

MANUALLY PROGRAMMABLE AUDIBLE ALARM SYSTEM

BACKGROUND OF THE INVENTION

Conventional audible alarm systems have been provided to indicate not only the occurrence of an emergency but also the location of an emergency. The programming of the alarm system to produce audible soundings indicating emergency locations has taken different forms. However, these systems suffer from operator inconsistency or error during times of an emergency. Inconsistency in timing the audible alarms makes comprehension of a location for the emergency difficult. Also, the time required to manually operate the alarm system under emergency conditions could be better used in protecting personnel or property and in combating the emergency. There exists, therefore, the need for a new and improved alarm system where emergency locations can be quickly and easily programmed into an audible alarm system.

SUMMARY OF THE INVENTION

In accordance with the present invention, a manually activated alarm system is provided to produce an audible alarm indicating that an emergency has occurred and a plurality of successive audible tones identifying the location of the emergency.

The location of the emergency is coded into the alarm system through a manually operable switch. A counter accumulates a count of the number of closures of the switch. A first timer is turned ON in response to the first closure of the switch, the timer being ON for the duration of a preset time period. An audible alarm is sounded during this preset time period as a warning that an emergency has occurred. A second timer is turned ON at the termination of the time period of the first timer. This second timer remains ON for the duration of a preset time period during which no audible tone is sounded. A third timer is turned ON at the termination of the time period of the second timer. This third timer remains ON for the duration of a preset time period during which an audible tone is sounded. Following the termination of this audible tone, the second and third timers are reset and restarted. This recycling of these timers continues until the cumulative total of audible tones sounded equals the total count of the number of closures of the switch as indicated by the counter.

DESCRIPTION OF THE PREFERRED EMBODIMENT

Figure 1:
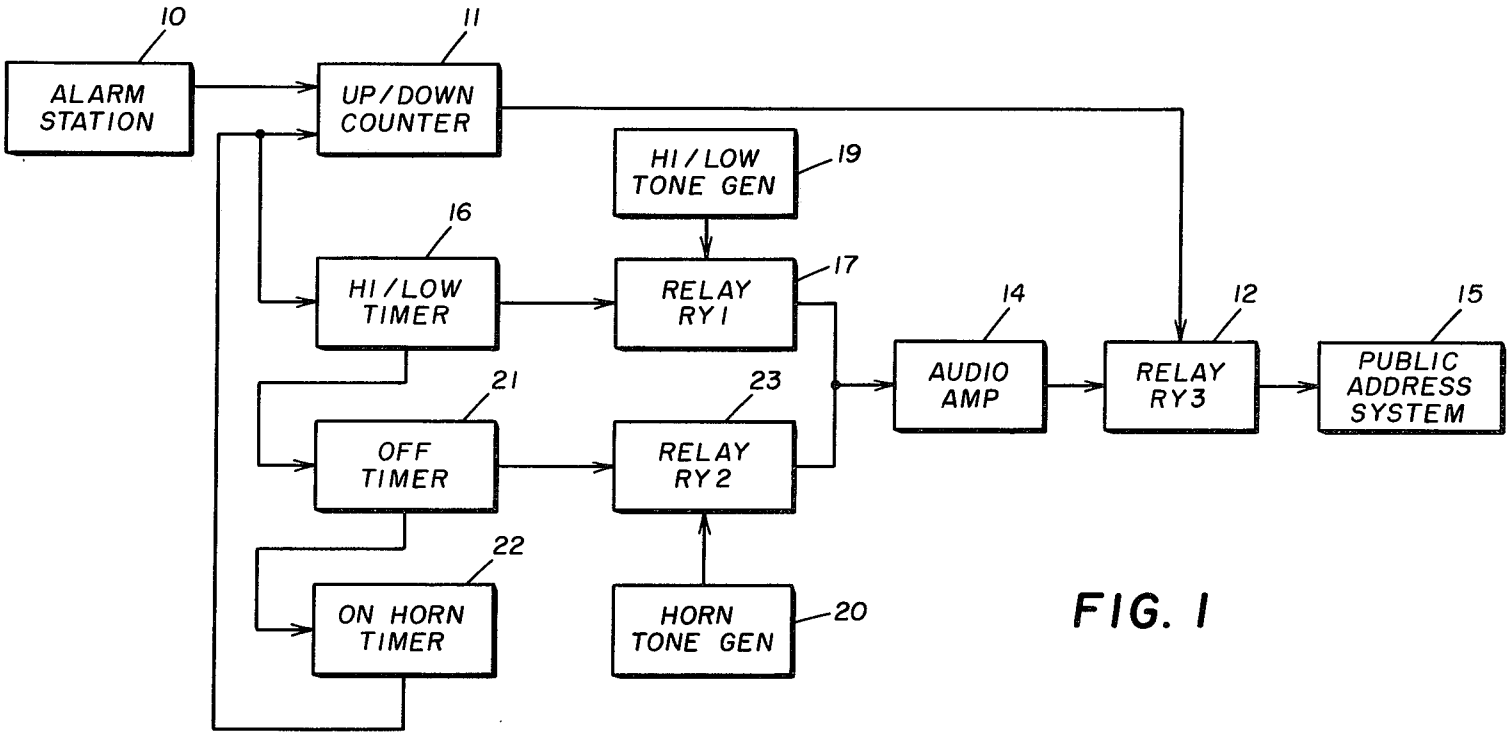
FIG. 1 illustrates in block diagram form the alarm system of the present invention.

FIG. 1 illustrates the audible alarm system of the present invention. An operator codes the location of an emergency at any of a plurality of parallel-wired alarm stations 10. This encoding is preferably carried out by the energization of a push-button switch a predetermined number of times for a given location. The UP/-DOWN counter 11 counts the number of times the push-button switch has been depressed and stores this count. Upon depression of the push-button switch the first time, the UP/DOWN counter 11 energizes the relay 12 to couple the audioamplifier 14 to the public address system 15. In addition, the high-low timer 16 is started and the relay 17 is energized to couple the high-low tone generator 19 to the audioamplifier 14. As a consequence, a high-low tone alarm is sent out over the public address system to indicate that an emergency exists and to notify personnel to then listen for a plurality of successive audible horn tones indicating the location code of the emergency. The time period of the high-low warning alarm tone is preset in the high-low timer 16. When this time period is completed, the high-low timer 16 deenergizes the relay 17 and starts the OFF timer 21. Deenergization of relay 17 disconnects the high-low tone generator 19 and the high-low warning tone ceases. After a preset OFF period determined by the timer 21, the ON horn timer 22 is started and the relay 23 is energized. Relay 23 couples the horn tone generator 20 to the audioamplifier 14. The public address system 15 thereby generates a horn tone for a period of time established by the ON horn timer 22. When this time period is completed, the ON horn timer deenergizes the relay 23 and provides for a countdown pulse to the UP/DOWN counter 11 to indicate that the horn tone has blown one time.

It is to be remembered that the count initially stored in the UP/DOWN counter 11 represents the location for the emergency as encoded by the number of times the push-button switch in the alarm system 10 is activated. Consequently, the horn tone is to be blown a number of times equal to the encoded count. As the UP/DOWN counter is counted DOWN one count by the first horn tone, the OFF timer 21 and On horn timer 22 are again sequentially turned ON to provide for an additional horn tone to be blown. This recycling of the OFF timer 21 and ON horn timer 22 continues until the count in the UP/DOWN counter 11 is reduced to zero. At this point, the horn tone has been sounded one time for each activation of the alarm switch so as to indicate the location of the emergency.

Referring now to FIGS. 2–5, a detailed description of a preferred embodiment for the alarm system of FIG. 1 will be set forth.

Figure 2:
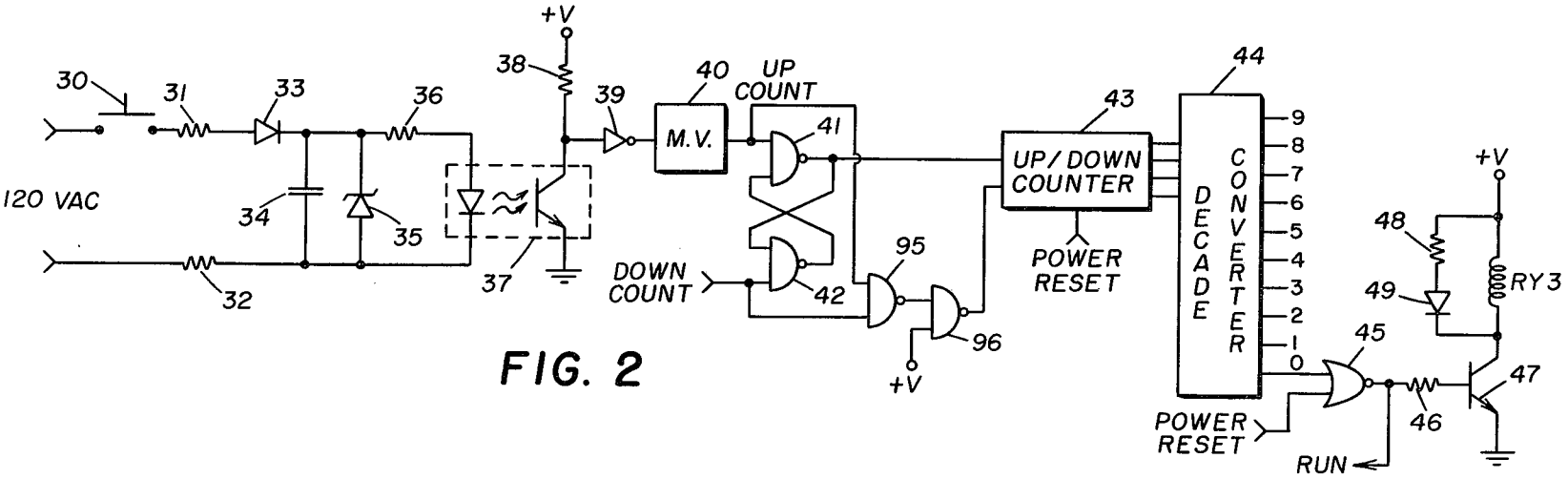
FIGS. 2–5 are electrical schematics of the alarm system of FIG. 1.

Referring first to FIG. 2, activation of the push-button switch 30 applies a 120-volt AC supply through resistors 31 and 32 and half-wave rectifier 33 to the filter capacitor 34. A Zener diode 35 holds the voltage across the filter capacitor to 15 volts. Resistor 36 is a biasing resistor for the light-emitting diode in an optically coupled isolator 37. The phototransistor in the isolator 37 is turned ON when the push-button switch is closed. Output of the isolator 37 is applied through the output resistor 38 and inverter 39 to the input of a monostable multivibrator 40. The output of multivibrator 40 is an UP signal which latches the two NAND gates 41 and 42 to provide for an UP count pulse to the UP/DOWN counter 43. The UP/DOWN counter 43 continues to count-up the pulses which are being provided by the closures from the push-button switch 30 up to a maximum of 16 counts, for example. The output of the UP/-DOWN counter 43 is a 4-bit binary output applied to the decade converter 44 which converts binary-coded decimal to a series of decade outputs 0 through 9. Upon the first closure of the push-button switch 30, the 0 output of the decade converter 44 passes through NOR gate 45 and resistor 46 to turn ON transistor 47 and thereby energize relay RY3. Transistor 47 also turns ON light-emitting diode 49 through resistor 48 to provide visual indication that RY3 is energized. As pointed out above with respect to FIG. 1, the energization of relay RY3 couples the audioamplifier 14 to the public address system 15.

Figure 4:
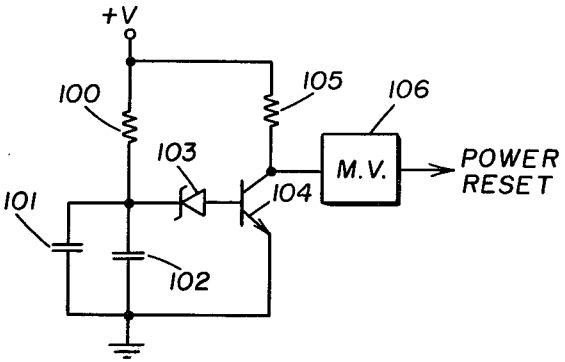
Figure 5:
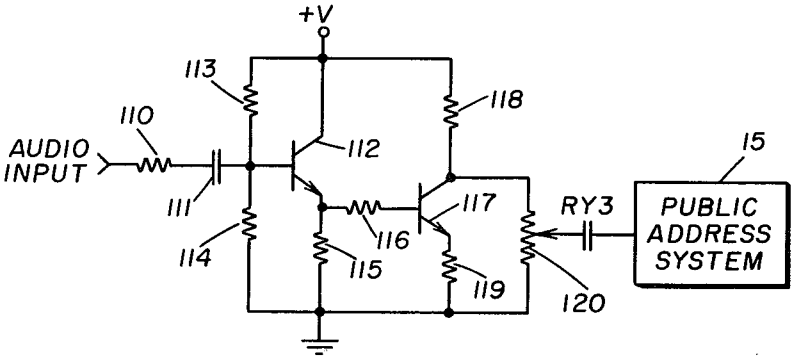
Figure 3:
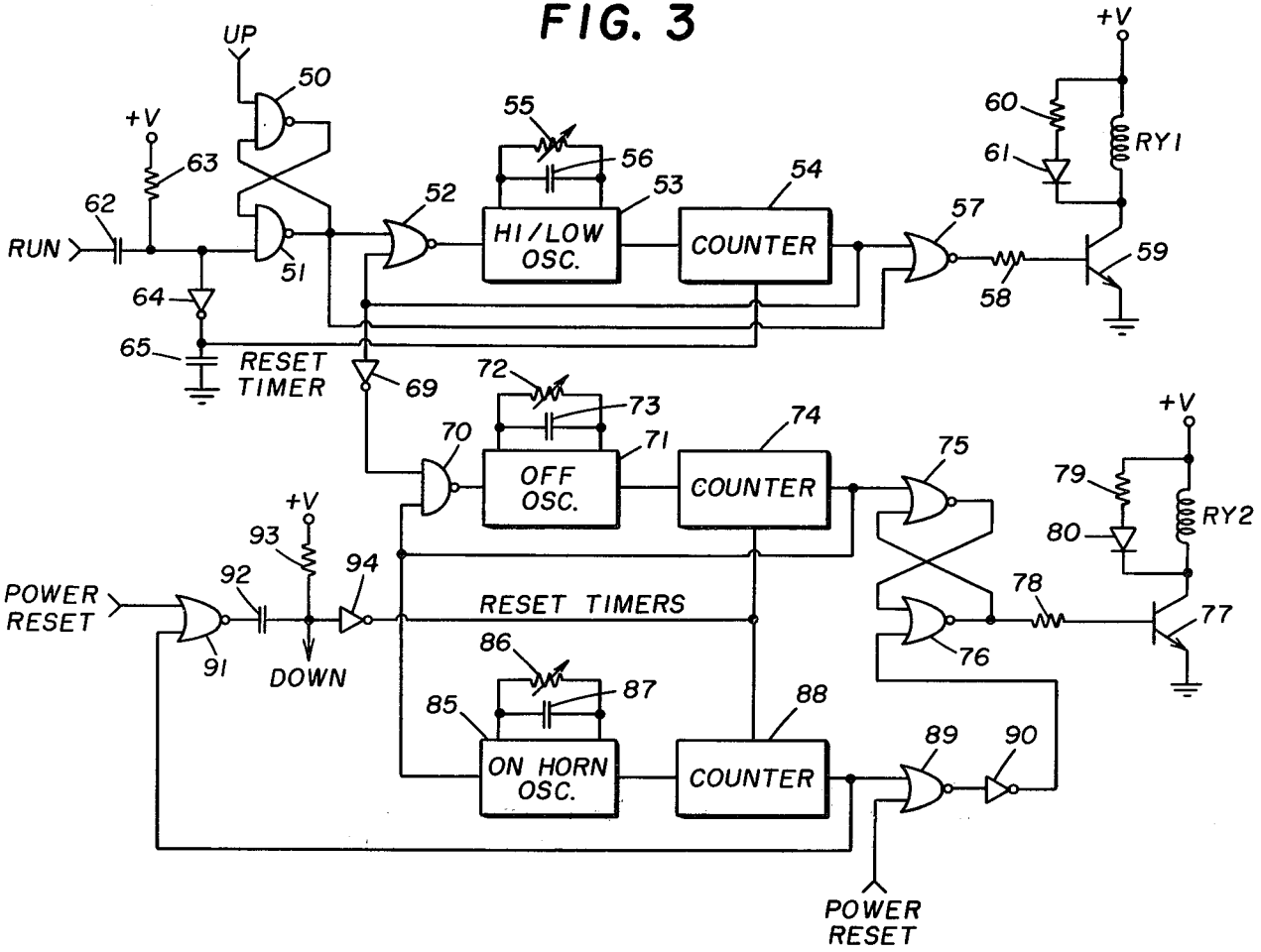

Referring now to FIGS. 3, 4, and 5, there will be discussed the circuitry by which such audiopower is generated so that the proper warning tones and location tones can be broadcast over the public address system 15. Referring first to FIG. 3, an UP pulse from multivibrator 40 latches the two NAND gates 50 and 51 so as to provide, by way of NOR gate 52, a trigger pulse for the high-low oscillator 53. At this time, transistor 59 is turned ON through NOR gate 57 and resistor 58 in response to the latching of NAND gates 50 and 51. When transistor 59 is turned ON, relay RY1 is energized to couple the high-low tone generator 19 to the audioamplifier 14. This provides the high-low tone to be broadcast over the public address system 15 to warn individuals that there is an emergency and to listen for the plurality of successive horn tones that are to follow, the code of which indicates location of the emergency. This high-low tone remains ON for a period of time determined by the oscillator 53 and counter 54. Oscillator 53 provides a frequency output fixed by means of the potentiometer 55 and capacitor 56. The pulses from this oscillator are counted by a ripple-through counter 54 to provide a binary output. When this binary output indicates that a predetermined period of time has elapsed, in the order of 1 to 30 seconds, for example, the NOR gate 57 and resistor 58 are set to turn transistor 59 OFF and thereby deenergize relay RY1. Light-emitting diode 61, biased by resistor 60, is turned ON and OFF by transistor 59 to provide visual indication of relay RY1 being energized or deenergized.

When the relay RY1 is deenergized by the output of the counter 54, the high-low oscillator 53 is turned OFF through NOR gate 52 and at the same time sets inverter 69 and NAND gate 70 to turn ON the OFF oscillator 71 located in the OFF timer unit 21. The frequency of this oscillator is set by the potentiometer 72 and the capacitor 73. Counter 74 is also a ripple-through counter which counts the pulses from the oscillator 71. When a given number of pulses have been counted by the counter 74, the two NAND gates 75 and 76 are latched to turn transistor 77 ON through its input resistor 78. This energizes relay RY2 and turns ON light-emitting diode 80, biased by resistor 79, for visual indication that RY2 is energized. Upon energization of relay RY2, the horn tone generator 20 is coupled to the audioamplifier 14. At the same time, the oscillator 71 is turned OFF, and NAND gate 70 and the ON horn oscillator 85 is turned ON. The frequency of this oscillator is set by the potentiometer 86 and the capacitor 87. The pulses from oscillator 85 are counted by the ripple-through counter 88. When a predetermined count is reached by the counter 88, the output of this counter sets NOR gate 89, inverter 90, and the latch formed by the two NAND gates 75 and 76 to turn OFF transistor 77 through its input resistor 78 and thereby deenergize the relay RY2. At this point, the horn tone generator 20 is disconnected from the audioamplifier 14. The output of the counter 88 is also applied by way of NAND gate 91, capacitor 92, resistor 93, and inverter 94 to reset both the counter 74 of the OFF timer 21 and the counter 88 itself. Further, this signal from the counter 88, after passing through NAND gate 91, capacitor 92, and resistor 93, is utilized as a DOWN pulse which is applied to the latch formed by the two NAND gates 41 and 42 in the UP/-DOWN counter 11, as illustrated in detail in FIG. 2. This DOWN pulse, as shown in FIG. 2, passes through NAND gate 95 and NAND gate 96 to advance the UP/DOWN counter DOWN by one count, indicating that one horn tone has been generated. Consequently, the output of the decade converter 44 will be advanced downward by one decimal. So long as the decimal count exceeds the zero level, the cycle of OFF periods and ON horn periods will continue. This is true because the latch of the two NAND gates 50 and 51 prevents the high-low timer 16 from being reset, which, in turn, means that the output of the counter 54, as applied by way of inverter 69 and gate 70, starts the OFF oscillator 71 and counter 74 of the OFF timer and the ON horn oscillator 85 and counter 88 of the ON horn timer to again go through the same sequence of events as before. This sequence of events will continue until the output of the DOWN decade converter 44 reaches zero, at which time the transistor 47 is turned OFF to thereby deenergize the relay RY3 to disconnect the audioamplifier 14 from the public address system 15. At the same time, a RUN signal is applied from the output of the decade converter 44 through the NOR gate 45 to the input capacitor 62 and resistor 63 of the high-low timer in FIG. 3. This resets the latch provided by the two NAND gates 50 and 51 which holds relay RY1 deenergized through NOR gate 57, input resistor 58, and transistor 59. The RUN signal is also applied through the inverter 64 as a timer reset to the counter 54. At this point the entire system has been reset and is ready for the application of the next alarm at the alarm station.

To further allow for reset of the circuits on power dips or power interruptions which could cause unnecessary reduction of warning tones and horn tones, there is provided the circuitry of FIG. 4. This circuit creates a pulse after each power dip or power interruption to reset the circuit to its normal nonalarm state. The charging rate and the RC time constant provided by the resistor 100 and capacitors 101 and 102 cause the junction between this resistor and these capacitors to slowly approach the supply voltage +V at a charging rate of the RC constant. When the voltage at this junction reaches the breakdown voltage established by the Zener diode 103, the diode will begin conducting to turn ON transistor 104 and provide an output to its output resistor 105 to trigger a monostable multivibrator 106. The output of this multivibrator 106 is a power reset signal which is applied at various points within the system as indicated in FIGS. 2 and 3 to reset each circuit back to its normal nonalarm condition.

Referring now to FIG. 5, the audioamplifier 14 applies the output from high-low tone generator 19 when relay RY1 is energized or the output from horn tone generator 20 when relay RY2 is energized through coupling resistor 110 and capacitor 111 to the base input of the emitter-follower transistor 112. The output of transistor 112 is applied through resistor 116 to the base input of the power output transistor 117. Biasing is supplied by resistors 113-115, 118, and 119. The output from transistor 117 is applied as the audio output to the public address system 15 through the potentiometer 120 and energized relay RY3.

In accordance with one embodiment of the present invention, TABLE I sets forth types and values of circuit components as illustrated in the drawings.

TABLE I

| Reference Designation | Description |
|---|---|
| Tone generator 19 | Model TM-3 (Federal Sign and Signal Corp.) |

TABLE I-continued

| Reference Designation | Description |
|---|---|
| Tone generator 20 | Model TM-6 (Federal Sign and Signal Corp.) |
| Multivibrators 40, 53, 71, 85, and 106 | CD4047 (R.C.A.) |
| Optically coupled isolator 37 | 4N37 (Monsanto) |
| Counter 43 | CD4029 (R.C.A.) |
| Counters 54, 74, and 88 | CD4020 (R.C.A.) |
| Converter 44 | CD4028 (R.C.A.) |
| Transistors 47, 59, and 77 | HEP Type S0015 (Motorola) |
| Transistor 112 | HEP Type S0015 (Motorola) |
| Transistor 117 | HEP Type S0015 (Motorola) |
| Latches 40–41 and 50–51 | CD4011 (R.C.A.) |
| Relays RY1, RY2, and RY3 | HP11D (Potter-Brumfield) |
| Zener diode 35 | 15 volts |
| Zener diode 103 | 9.1 volts |
| +V | 12-volt supply |
| Inverters 39, 64, 90, and 94 | CD4049 (R.C.A.) |
| Gates 45, 51, 52, 70, 75 76, 89, 95, and 96 | CD4001 (R.C.A.) |
| Diodes 33, 49, 61, and 80 | RCT (R.C.A.) |

I claim:

1. An alarm system comprising:

(a) a manually operable switch, (b) a counter for accumulating a count of the closures of said switch, (c) a first timer that is turned ON in response to the first closure of said switch, said timer being ON for the duration of a preset time period, (d) means for producing a first audible tone during the period of said first timer, (e) a second timer that is turned ON in response to the termination of the time period of said first timer, said timer being ON for the duration of a preset time period during which no audible tone is sounded, (f) a third timer that is turned ON in response to the termination of the time period of said second timer, said third timer being ON for the duration of a preset time period, (g) means for producing a second audible tone during the period of said third timer, and (h) means for reinitiating the successive time periods of said second and third timers until the cumulative total of second audible tones equals the count of switch closures accumulated in said counter.

2. The system of claim 1 wherein each of said timers comprises:

(a) an oscillator having a fixed frequency output, and (b) a counter which counts each cycle of the output of said oscillator and produces a signal when a predetermined number of counts is reached, said predetermined number of counts being representative of the termination of said preset time period.

3. The system of claim 1 wherein said means for producing said first audible tone comprises:

(a) a transistor that is turned ON in response to the first closure of said switch, (b) a relay that is energized by the turning ON of said transistor, (c) a tone generator, (d) an audioamplifier that is coupled to the output of said first tone generator through the energization of said relay, and (e) a public address system that is coupled to the output of said audioamplifier for sounding an audible alarm of the tone provided by said tone generator.

4. The system of claim 1 wherein said means for producing a second audible tone comprises:

(a) a transistor that is turned ON in response to the termination of the time period of said second timer, (b) a relay that is energized by the turning ON of said transistor, (c) a tone generator, (d) an audioamplifier that is coupled to the output of said tone generator through the energization of said relay, and (e) a public address system that is coupled to the output of said audioamplifier for sounding an audible alarm of the tone provided by said tone generator.

5. The system of claim 1 wherein:

(a) said counter is advanced UP one count in response to each closure of said switch, and (b) said counter is advanced DOWN one count in response to the termination of the time period of said third timer, the reinitiation of the time periods of said second and third timers being terminated when said counter is advanced DOWN to zero.

* * * * *